US008904759B2

(12) United States Patent
Heverley, III et al.

(10) Patent No.: US 8,904,759 B2
(45) Date of Patent: Dec. 9, 2014

(54) SYSTEM AND METHOD FOR TREATING PARTICULATE MATTER VENTED FROM AN ENGINE CRANKCASE

(75) Inventors: Lawrence Hoey Heverley, III, Erie, PA (US); James Robert Mischler, Erie, PA (US)

(73) Assignee: General Electric Company, Schenectady, NY (US)

( * ) Notice: Subject to any disclaimer, the term of this patent is extended or adjusted under 35 U.S.C. 154(b) by 1006 days.

(21) Appl. No.: 12/889,638

(22) Filed: Sep. 24, 2010

(65) Prior Publication Data

US 2012/0073269 A1 Mar. 29, 2012

(51) Int. Cl.

| | |
|---|---|
| ***F01N 3/18*** | (2006.01) |
| ***F01M 13/04*** | (2006.01) |
| ***F01M 13/00*** | (2006.01) |
| ***F01M 13/02*** | (2006.01) |

(52) U.S. Cl.

CPC ..... *F01M 13/04* (2013.01); *F01M 13/00* (2013.01); *F01M 13/02* (2013.01)

USPC ..... 60/283

(58) Field of Classification Search

CPC ..... F01M 13/00; F01M 13/02; F01M 13/04

USPC ..... 60/283, 295, 311; 123/572, 573

See application file for complete search history.

(56) References Cited

U.S. PATENT DOCUMENTS

| | | | | |
|---|---|---|---|---|
| 5,937,837 | A * | 8/1999 | Shaffer et al. | 123/573 |
| 6,196,207 | B1 | 3/2001 | Megas | |
| 6,691,687 | B1 * | 2/2004 | Liang et al. | 123/572 |
| 2004/0103645 | A1 * | 6/2004 | Bedapudi | 60/280 |
| 2007/0084194 | A1 | 4/2007 | Holm | |
| 2007/0107709 | A1 * | 5/2007 | Moncelle et al. | 123/572 |

FOREIGN PATENT DOCUMENTS

| | | | | |
|---|---|---|---|---|
| DE | 102004004956 | A1 | 8/2005 | |
| EP | 1045117 | A1 | 10/2000 | |
| EP | 1921283 | A2 | 5/2008 | |
| FR | 2733798 | A1 * | 11/1996 | F02M 25/00 |
| WO | 2009054777 | A1 | 4/2009 | |

OTHER PUBLICATIONS

International Search Report and Written Opinion issued in connection with corresponding PCT Application No. PCT/US2010/058179 on Jun. 1, 2011.

* cited by examiner

*Primary Examiner* — Kenneth Bomberg
*Assistant Examiner* — Jonathan Matthias
(74) *Attorney, Agent, or Firm* — GE Global Patent Operation; John A. Kramer

(57) ABSTRACT

System and methods for treating particulate matter vented from an engine crankcase are provided. In one embodiment, an engine includes a crankcase. A ventilation hose is coupled to the engine to vent a crankcase gas from the crankcase. A catalytic emissions control device is coupled to the ventilation hose to treat particulate matter in the crankcase gas.

16 Claims, 3 Drawing Sheets

SYSTEM AND METHOD FOR TREATING PARTICULATE MATTER VENTED FROM AN ENGINE CRANKCASE

FIELD

The subject matter disclosed herein relates to treatment of particulate matter vented from an engine crankcase.

BACKGROUND

During engine operation, unburned fuel and exhaust gas escape from the combustion chamber, past the piston rings, and enter the crankcase. Over time, the unburned fuel and exhaust gas condense and dilute the engine oil in the crankcase, which reduces the ability of the engine oil to lubricate the engine. In order to reduce dilution of the engine oil, an engine of a rail vehicle typically includes a ventilation system to draw in fresh air and expel unburned fuel and exhaust gas from the crankcase.

In one example, a vehicle includes an engine having a crankcase that is vented through a hose to a coalescer that filters the vented gas. For example, the coalescer includes steel wool that facilitates condensation of oil droplets in the gas stream. The condensed oil droplets are returned from the coalescer to the crankcase by a return line. Furthermore, an eductor tube is connected between the coalescer and an exhaust muffler. As gas flowing from the coalescer streams through the eductor tube, a pressure differential is created to generate vacuum for crankcase venting.

The inventors herein have recognized some issues in such systems. For example, any particulate matter in the gas stream vented from the crankcase that escapes filtration by the coalescer is drawn into the exhaust stream and exits the exhaust stack. In other words, the particulate matter vented from the crankcase that is not filtered by the coalescer contributes to emissions of the vehicle.

BRIEF DESCRIPTION OF THE INVENTION

Accordingly, to address the above issues, various embodiments of systems and methods for treating particulate matter vented from an engine crankcase are described herein. For example, in one embodiment, an engine system comprises an engine that includes a crankcase. A ventilation hose is coupled to the engine to vent a crankcase gas from the crankcase. A catalytic emissions control device is coupled to the ventilation hose to treat particulate matter in the crankcase gas. As discussed above, although a coalescer can be used to condense some oil droplets in the crankcase gas, particulate matter still remains. Thus, by treating the crankcase gas with a catalytic emissions control device, particulate matter that remains in the crankcase gas can be catalytically burned up and removed. In this way, emissions, such as particulate emissions, due to crankcase ventilation can be reduced.

This brief description is provided to introduce a selection of concepts in a simplified form that are further described herein. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure. Also, the inventor herein has recognized any identified issues and corresponding solutions.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
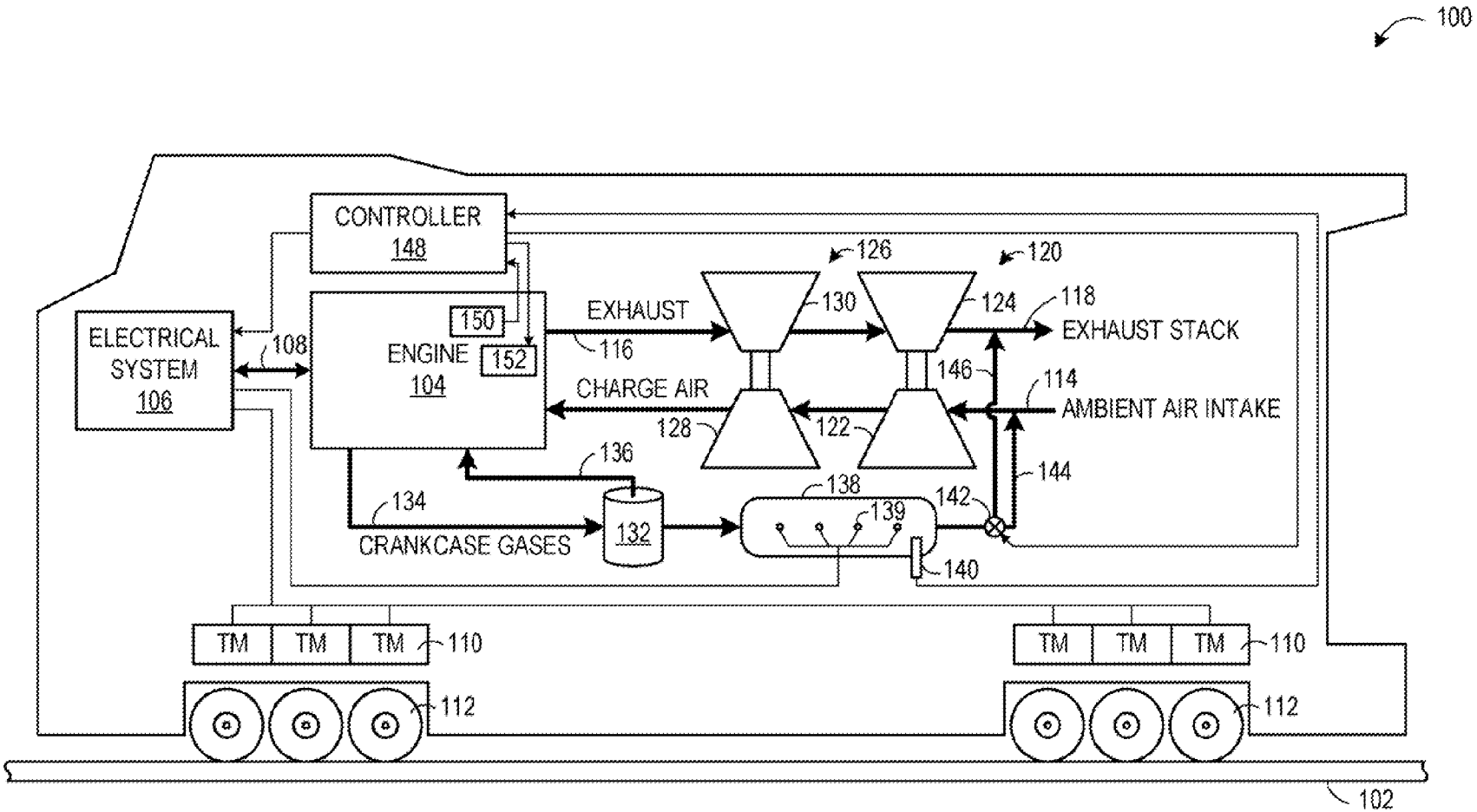
FIG. 1 is a schematic diagram of an example embodiment of a rail-vehicle system of the present disclosure.
Figure 2:
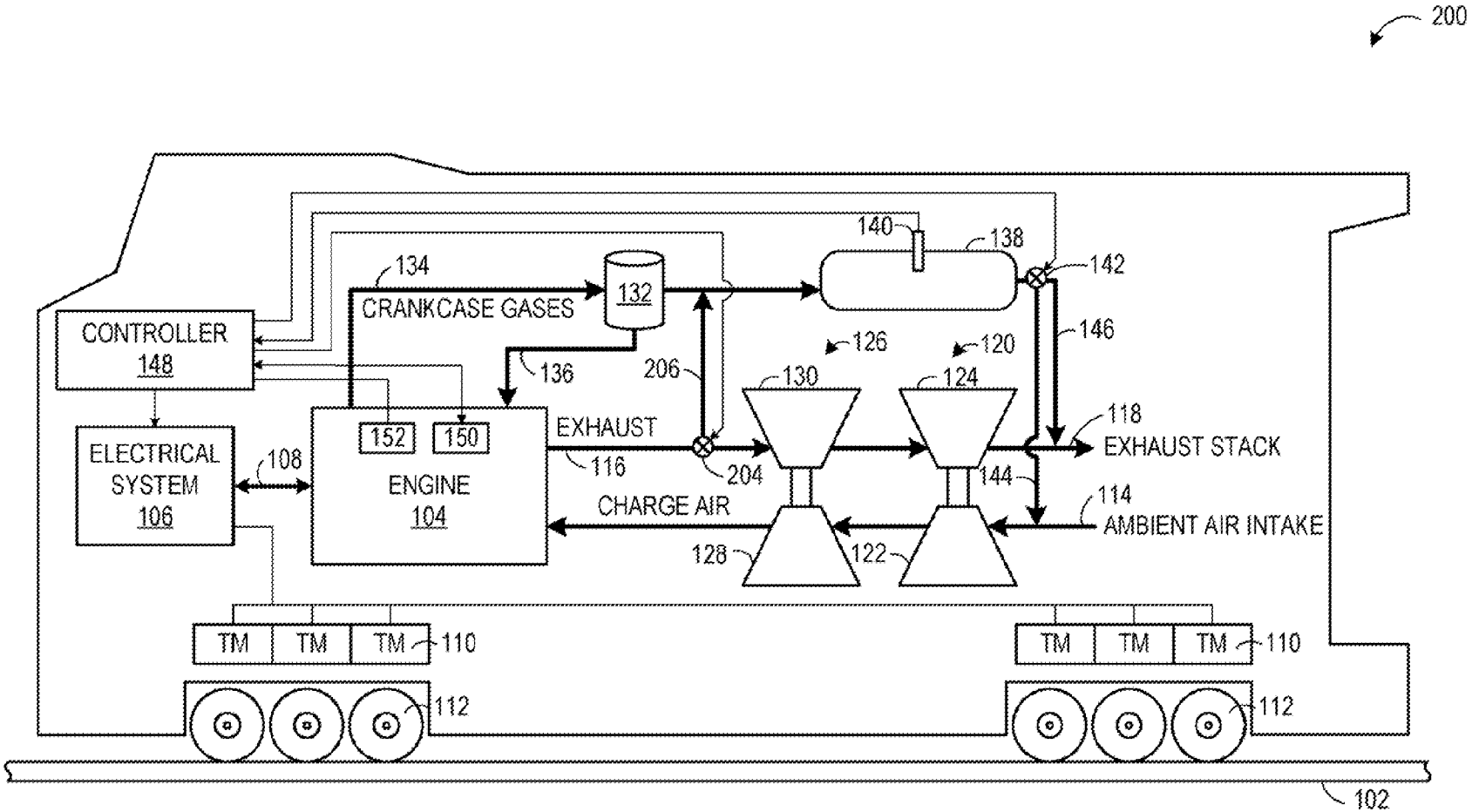
FIG. 2 is a schematic diagram of another example embodiment of a rail-vehicle system of the present disclosure.
Figure 3:
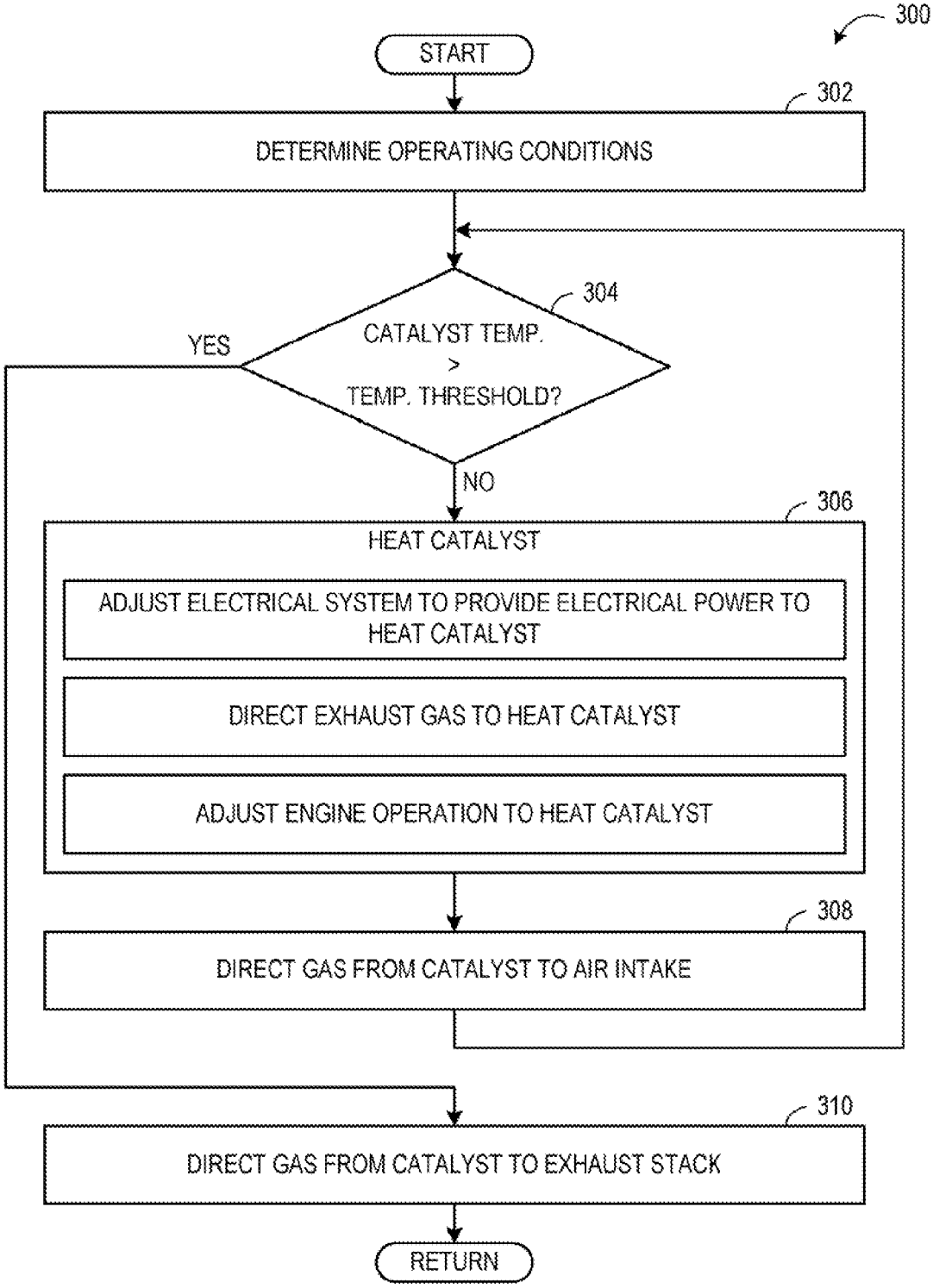
FIG. 3 is a flow diagram of an example embodiment of a method for operating a rail-vehicle system to treat crankcase gases for particulate matter.

An Off-highway vehicle, such as a rail vehicle, includes an engine that has a crankcase, which is vented to expel unburned fuel and exhaust gas. The gas vented from the crankcase is treated by an emissions control device to remove particulate matter from the gas stream. An example embodiment of a rail vehicle system, as illustrated in FIG. 1, includes an electrically-heated emissions control device that burns particulate matter in the gas stream vented from the crankcase. In another example embodiment of a rail vehicle system, as illustrated in FIG. 2, an emissions control device receives a combination of gas vented from the crankcase as well as gas exhausted from cylinders of the engine. The exhaust gas heats the emissions control device to a light-off temperature range in order to burn particulate matter in the combined gas stream. FIG. 3 shows an example embodiment of a method for operating a rail-vehicle system, such as the rail-vehicle systems illustrated in FIGS. 1-2, to reduce an amount of particulate matter in a gas stream vented from an engine crankcase. In this manner, emissions of the rail-vehicle system may be reduced.

FIG. 1 is a block diagram of an example embodiment of a vehicle or vehicle system, herein depicted as a rail vehicle 100, configured to run on a rail 102. The rail vehicle 100 includes an engine 104. The engine 104 receives intake air for combustion from an air-intake passage 114. The air-intake passage 114 receives ambient air from an air filter (not shown) that filters air from outside of the rail vehicle 100. Exhaust gas resulting from combustion in the engine 104 is supplied to an exhaust passage 116. Exhaust gas flows through the exhaust passage 116, and out of an exhaust stack 118 of the rail vehicle 100. In one example, the engine 104 is a diesel engine that combusts air and diesel fuel through compression ignition. In other non-limiting embodiments, the engine 104 may combust fuel including gasoline, kerosene, biodiesel, or other petroleum distillates of similar density through compression ignition (or spark ignition).

In one example, the rail vehicle 100 is a diesel-electric vehicle. For example, the engine 104 is a diesel engine that generates a torque output that is transmitted to an electrical system 106 along a drive shaft 108. The generated torque is used by an alternator (not shown) of the electrical system 106 to generate electricity for subsequent propagation to a variety of downstream electrical components. For example, the electrical system 106 provides electrical power to a plurality of traction motors 110. The plurality of traction motors 110 are each connected to one of a plurality of wheels 112 to provide tractive power to propel the rail vehicle 100. One example rail vehicle configuration includes one traction motor per wheel. As depicted herein, six pairs of traction motors correspond to each of six pairs of wheels of the rail vehicle. The plurality of fraction motors 110 are also configured to act as generators providing dynamic braking for the rail vehicle 100. In particular, during dynamic braking, the plurality of traction motors 110 provide torque in a direction that is opposite from the rolling direction, thereby generating electricity that is provided to different sources based on operating conditions. For example, the electricity is provided to electrically heat an emissions control device 138. As another example, the electricity is dissipated as heat by a grid of resistors included in the electrical system 106. As yet another example, the electricity is stored in an electrical storage device (e.g., a battery) included in the electrical system 106.

The engine 104 includes two stages of turbochargers that are arranged between the air-intake passage 114 and the exhaust passage 116. The two stages of turbochargers increase air charge of ambient air drawn into the air-intake passage 114 in order to provide greater charge density during combustion to increase engine operating efficiency. A first turbocharger 120 includes a compressor 122 arranged along the air-intake passage 114. The compressor 122 is at least partially driven by a turbine 124 (e.g., through a shaft) that is arranged in the exhaust passage 116. A second turbocharger 126 is positioned downstream from the first turbocharger 120 between the first turbocharger and the engine 104. The second turbocharger 126 includes a compressor 128 arranged along the air-intake passage 114. The compressor 128 is at least partially driven by a turbine 130 (e.g., through a shaft) that is arranged in the exhaust passage 116.

In some embodiments, the two stages of turbochargers are arranged in series and are configured to operate at different engine speeds to provide compression quickly with reduced lag across the operating range of the engine 104. For example, the first turbocharger 120 may be a smaller, high-pressure, lower output turbocharger that spools up quickly to provide compression at lower engine speeds. Correspondingly, the second turbocharger 126 may be a larger, low-pressure, higher output turbocharger that operates at higher engine speeds to provide greater boost.

In some embodiments, the two stages of turbochargers operate sequentially to provide a greater amount of boost during particular operating ranges. In such a configuration, two similarly sized turbochargers are arranged in sequence and operate at the same time. In particular, the first turbocharger 120 boosts pressure to a first pressure level, then the second turbocharger 126 receives charged air from the first turbocharger 120 and compresses it further to a higher boost pressure that would not be possible to generate by a single turbocharger. This configuration may be beneficial for a diesel engine, since diesel engines do not suffer from pre-ignition issues and can use significantly higher boost pressure than spark ignition engines.

The engine 104 forms a crankcase that is vented to remove exhaust gas and unburned fuel from the crankcase in order to reduce dilution of engine oil in the crankcase. The crankcase is vented through a ventilation hose 134. In some embodiments, the ventilation hose 134 is connected to a venturi-like tube in the exhaust stack 118 that creates a vacuum to vent the crankcase of the engine 104. The ventilation hose 134 connects to a coalescer 132 so that a gas stream vented from the crankcase flows through the coalescer 132 where the gas stream is filtered. In particular, the coalescer 132 condenses oil droplets in the gas stream, and the condensed oil droplets are returned to the crankcase through a return line 136. In one example, the coalescer 132 is a canister that includes steel wool that facilitates condensation of oil droplets from the crankcase gas stream.

As discussed above, although the coalescer condenses oil from the gas stream vented from the crankcase, particulate matter still remains in the gas stream which, when vented from the exhaust stack 118, increases emissions of the rail vehicle 100. In order to reduce emissions due to crankcase ventilation, the rail vehicle 100 includes an emissions control device 138 that is positioned downstream of coalescer 132. The emissions control device 138 is connected to the coalescer 132 such that the emissions control device 138 receives a gas stream that is filtered by the coalescer 132. In one example, the emissions control device 138 includes a catalyst including a substrate and a washcoat, for example including one or more precious metals, such as palladium, with an alumina wash coat. In another example, a zeolite-based catalyst may be used. In still another example, a particulate filter may be used.

The emissions control device 138 can be heated in a variety of ways to reach a light-off temperature to burn particulate matter in the crankcase gas stream. In the illustrated embodiment, the emissions control device is an electrically-heated emissions control device. The electrically-heated emissions control device includes ports 139 that connect with electric leads from the electrical system 106. The electrical system 106 selectively provides electrical power to the ports 139 which is converted to heat to increase the temperature of the emissions control device 138 to the light-off temperature. Upon reaching the light-off temperature, the emissions control device 138 burns particulate matter in the gas stream vented from the crankcase. Emissions control device temperature is monitored by a temperature sensor 140. In one example, the temperature sensor 140 is a thermocouple embedded in the emissions control device 138. In another example, the temperature sensor 140 is positioned downstream of the emissions control device and senses the temperature of the gas stream exiting the emissions control device 138.

A valve 142 is positioned downstream of the emissions control device 138 to control the flow of the crankcase gas stream exiting from the emissions control device. In one example, the valve 142 is a three-way valve that directs the gas stream to an intake line 144 or an exhaust line 146. The intake line 144 connects to the air-intake passage 114 upstream of the two stages of turbochargers to pass the gas stream back to the engine. The exhaust line 146 connects to the exhaust stack 118 to exhaust the gas stream from the rail vehicle 100. As will be discussed in further detail below with reference to FIG. 3, the state of valve 142 is adjusted to vary flow of the gas stream to different locations based on operating conditions of the rail vehicle.

In some embodiments, the intake line 144 may be omitted and the gas stream may be directed to the exhaust stack 118 through the exhaust line 146 without being directed to the air-intake passage 114. In some embodiments, the exhaust line 146 may be omitted and the gas stream may be directed to the air-intake passage 114 through the intake line 144 without being directed to the exhaust stack 118.

The rail vehicle 100 includes a controller 148 to control various components related to the engine 104 and the electrical system 106. In one example, the controller 148 includes a computer control system. The controller 148 further includes computer readable storage media including code for enabling on-board monitoring and control of rail vehicle operation. The controller 148, while overseeing control and management, may be configured to receive signals from a variety of engine sensors 150, as further elaborated herein, in order to determine operating parameters and operating conditions, and correspondingly adjust various engine actuators 152 to control operation of the rail vehicle 100.

For example, the controller 148 receives a temperature signal from the temperature sensor 140 and adjusts operation of the electrical system 106 to provide electrical power to the ports 139. The electrical power is converted to heat to increase the temperature of the emissions control device 138 to a designated temperature to burn off particulate matter from the crankcase gas stream. As another example, the controller 148 adjusts the state of valve 142 based on the temperature of the emissions control device. For example, the valve is adjusted to direct the crankcase gas stream to the air-intake passage 114 when the emissions control device temperature is below the light-off temperature, and the valve 142 is adjusted to direct the crankcase gas stream to the exhaust stack 118 when the emissions control device temperature is greater than the light-off temperature. Accordingly, the crankcase gas stream is recycled to the engine cylinders when the emissions control device is unable to burn the particulate matter in the crankcase gas stream. In this way, emissions of the rail vehicle can be reduced.

Furthermore, the controller 148 may receive signals from various engine sensors 150 including, but not limited to, engine speed, engine load, boost pressure, exhaust pressure, ambient pressure, etc. Correspondingly, the controller 148 may control the engine 104 and electrical system 106 by sending commands to various components such as the traction motors, alternator, cylinder valves, throttle, etc.

FIG. 2 is a block diagram of another example embodiment of a rail vehicle 200 that includes a crankcase ventilation configuration where an emissions control device is heated using high-pressure exhaust gas directed from the exhaust passage. Components of the rail vehicle 200 that are substantially the same as those of the rail vehicle 100 are identified in the same way and are described no further. However, it will be noted that components identified in the same way in different embodiments of the present disclosure may be at least partly different.

As discussed above, to reduce emissions due to crankcase ventilation, a crankcase gas stream flows through an emissions control device to burn up particulate matter in the gas stream. In order to burn up the particulate matter, the emissions control device has to operate in a temperature range above a light-off temperature. The rail vehicle 200 includes an emissions control device 138 that is heated to a light-off temperature at least partially using heat from exhaust gas.

Exhaust gas is directed from the exhaust passage 116 to the ventilation hose 134 through a bypass passage 206. The flow of exhaust gas through the bypass passage 206 is controlled by a bypass valve 204. The bypass valve 204 is positioned between the engine 104 and the second turbocharger 126 so that the bypass valve 204 is upstream of the first turbocharger 120 and the second turbocharger 126. As such, high-pressure exhaust gas is directed to the ventilation hose 134. The bypass passage 206 delivers exhaust gas to the ventilation hose 134 downstream of the coalescer 132. The high-pressure exhaust gas aids in creating vacuum in the ventilation hose 134 to draw gas from the crankcase of the engine 104. The exhaust gas stream combines with the crankcase gas stream at the intersection of the bypass passage 206 and the ventilation hose 134 and flows through the emissions control device 138. As the gas stream flows through the emissions control device 138 heat from the gas stream is transferred to the emissions control device 138 to increase the temperature of the emissions control device. Upon reaching a light-off temperature, the emissions control device 138 burns up particulate matter in the combination gas stream.

The valve 142 that is positioned downstream of the emissions control device 138 controls the flow of the gas stream that has been treated by the emissions control device. The controller 148 adjusts a state of the valve 142 based on operating conditions. For example, when the emissions control device temperature is below the light-off temperature, the emissions control device does not burn the particulate matter from the gas stream at a designated level, so the controller 148 adjusts the valve 142 to direct the gas stream down the intake line 144 to the air-intake passage 114 so that the particulate matter in the gas stream can be combusted by the engine 104. Correspondingly, when the emissions control device temperature is at or above the light-off temperature, the emissions control device can burn up the particulate matter in the gas stream at a designated level. Therefore, the controller 148 adjusts the valve 142 to direct the gas downstream of the emissions control device 138 through the exhaust line 146 to the exhaust stack 118 to be exhausted from the rail vehicle 100 since the particulate matter is substantially removed from the gas stream.

Furthermore, the controller 148 adjusts a state of the bypass valve 204 to adjust the flow of exhaust gas from the exhaust passage 116 through the bypass passage 206 to the emissions control device 138 based on operating conditions. For example, when the emissions control device temperature is below the light-off temperature, the controller 148 adjusts the bypass valve 204 to increase the amount of exhaust gas directed to the ventilation hose 134 to heat the emissions control device 138. During this operating condition, crankcase gas and exhaust gas flow through the emissions control device 138. Correspondingly, when the emissions control device temperature is at or above the light-off temperature, the controller 148 adjusts the bypass valve 204 to decrease the amount of exhaust gas that flows through the bypass passage 206 since the emissions control device 138 is already heated. This may include decreasing the amount of exhaust gas to little or no exhaust gas that flows through the bypass passage 206. During this operating condition, crankcase gas flows through the emissions control device 138 and little or no exhaust gas flows through the emissions control device 138. In some embodiments, the bypass valve 204 is a check valve that opens to create vacuum in the ventilation hose 134 without being adjusted by the controller 148. As such, the emissions control device 138 treats a combination of crankcase gas and exhaust gas.

The configurations illustrated above enable various methods for controlling a rail vehicle to treat crankcase gases by burning up particulate matter with an emissions control device. Accordingly, some such methods are now described, by way of example, with continued reference to the above configurations. It will be understood, however, that these methods, and others fully within the scope of the present disclosure, may be enabled by other configurations as well.

FIG. 3 is an example embodiment of a method 300 for operating a rail-vehicle system to treat crankcase gases for particulate matter. In one example, the method 300 is performed by controller 148 to adjust components of the rail vehicle 100 to electrically heat the emissions control device 138 to burn particulate matter in a crankcase gas stream. In another example, the method 300 is performed by controller 148 to adjust components of the rail vehicle 200 to direct high-pressure exhaust gas to heat the emissions control device 138 to burn particulate matter in a crankcase gas stream. Furthermore, rail vehicle components are adjusted to vary a travel path of crankcase gases based on emissions control device performance. At 302, the method includes determining operating conditions of the rail vehicle. Determining operating conditions includes receiving signals from sensors of the rail vehicle. Example sensor signals that are received include, but are not limited to, engine speed, engine air/fuel ratio, mass air pressure, mass air flow, ambient pressure, boost pressure, exhaust pressure, electrical power output, electrical power load, engine temperature, exhaust temperature, emissions control device temperature, etc. Furthermore, determining operating conditions includes determining a state of actuators of the rail vehicle. For example, a state of bypass valve 204 and valve 142 may be determined.

At 304, the method includes determining if an emissions control device temperature is greater than a temperature threshold. For example, the determination is made based on a temperature signal received from temperature sensor 140. In one example, the temperature threshold is the light-off temperature of the emissions control device 138. If it is determined that the emissions control device temperature is greater than the temperature threshold, the method moves to 310. Otherwise, the method moves to 306.

At 306, the method includes heating the emissions control device. Heating the emissions control device is performed in response to the temperature of the emissions control device being less than the temperature threshold. In embodiments that include an electrically-heated emissions control device, such as the rail vehicle 100, heating the emissions control device includes adjusting the electrical system 106 to direct electrical power to heat the emissions control device 138. In particular, the electrical system 106 provides electrical power through electrical leads to the ports 139 in the electrically-heated emissions control device. In some cases, such as during a braking condition when the plurality of traction motors 110 are generating electrical power, adjusting the electrical system 106 includes providing at least some electrical power generated by the plurality of traction motors 110 to heat the electrically-heated emissions control device 138.

Note, in some cases, the emissions control device can be heated even when the emissions control device temperature is above the temperature threshold. For example, when there is an abundance of electrical current produced by the plurality of traction motors during a regenerative braking condition, the electrical current can be provided to the electrically-heated emissions control device to provide a further increase in temperature beyond the light-off temperature so that the electricity is not wasted. In this way, the operating efficiency of the rail vehicle is increased.

In embodiments where exhaust gas is used to heat an emissions control device, such as the rail vehicle 200, heating the emissions control device includes directing exhaust gas through the emissions control device to heat the emissions control device. In one example, directing exhaust gas through the emissions control device includes adjusting a state of the bypass valve 204 to vary an amount of exhaust gas that is directed through the bypass passage 206 to the emissions control device 138. As an example, more exhaust gas is directed to the emissions control device when the emissions control device temperature is lower and less exhaust gas is directed to the emissions control device when the emissions control device temperature is higher. Furthermore, directing exhaust gas may include adjusting the state of the bypass valve 204 to adjust a pressure level in the ventilation hose 134 to generate vacuum to vent the crankcase of the engine 104. In some embodiments, heating the emissions control device includes adjusting one or more engine operating parameters to vary an exhaust enthalpy to adjust the emissions control device temperature. For example, an air/fuel ratio of the engine 104 can be adjusted rich and opening of exhaust valves can be retarded to increase the enthalpy of exhaust gas provided to the emissions control device in order to heat the emissions control device 138 more quickly.

At 308, the method includes directing a gas stream from the emissions control device to the air-intake passage. When the emissions control device 138 is less than the temperature threshold (e.g., the light-off temperature), the emissions control device 138 does not burn up particulate matter in the gas stream at a designated level. Therefore, the gas stream is directed from the emissions control device 138 to the air-intake passage 114, so that the particulate matter in gas stream can be combusted by the engine 104. In one example, directing the gas stream from the emissions control device 138 to the air-intake passage 114 includes adjusting a state of the valve 142 to direct the gas stream to travel through the intake line 144 to the air-intake passage 114. In some cases, when the gas stream is directed to the air-intake passage 114, the gas stream is not directed to the exhaust stack 118. In some cases, directing the gas stream from the emissions control device to the air-intake passage 114 may include increasing the amount of the gas stream that is directed to the air-intake passage 114 and decreasing the amount of the gas stream that is directed to the exhaust stack 118. As an example, more of the gas stream is directed to the air-intake passage at lower emissions control device temperatures and less of the gas stream is directed to the exhaust stack. As another example, more of the gas stream is directed to the exhausted stack at higher emissions control device temperatures and less of the gas stream is directed to the air-intake passage.

At 310, the method includes directing a gas stream from the emissions control device to the exhaust stack. When the emissions control device 138 is greater than the temperature threshold (e.g., the light-off temperature), the emissions control device 138 is hot enough to burn up particulate matter in the gas stream. Therefore, the gas stream is directed from the emissions control device 138 to the exhaust stack 118, so that the treated gas stream can be exhausted from the rail vehicle. In one example, directing the gas stream from the emissions control device 138 to the exhaust stack 118 includes adjusting a state of the valve 142 to direct the gas stream to travel through the exhaust line 146 to the exhaust stack 118. In some cases, directing the gas stream from the emissions control device to the exhaust stack 118 may include increasing the amount of the gas stream that is directed to the exhaust stack 118 and decreasing the amount of the gas stream that is directed to the air-intake passage 114.

By treating crankcase gas through an emissions control device, particulate matter in the crankcase gas can be burnt up. In this way, emissions due to particulate matter in the crankcase gas can be reduced. Moreover, by directing crankcase gas to the air-intake passage of the engine when the emissions control device is below the light-off temperature, the crankcase gas can be recycled to the engine to burn up the particulate matter in the gas stream. In this way, emissions due to particulate matter in the crankcase gas can be reduced even when the emissions control device is not hot enough to treat the crankcase gas.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A rail-vehicle system comprising:

an engine including a crankcase;

a ventilation hose coupled to the engine to vent a crankcase gas from the crankcase;

a catalytic emissions control device coupled to the ventilation hose to treat particulate matter in the crankcase gas;

an exhaust line coupled to the ventilation hose downstream of the catalytic emissions control device, the exhaust line connecting the ventilation hose to an exhaust stack;

an intake line coupled to the ventilation hose downstream of the catalytic emissions control device, the intake line connecting the ventilation hose to an air-intake passage;

a valve positioned downstream of the catalytic emissions control device, the valve being adjustable to direct the crankcase gas from the emissions control device to one or more of the exhaust line or the intake line; and a controller configured to adjust a state of the valve to direct the crankcase gas from the catalytic emissions control device to the intake line when a temperature of the catalytic emissions control device is less than a temperature threshold, and adjust the state of the valve to direct the crankcase gas from the catalytic emissions control device to the exhaust line when the temperature of the catalytic emissions control device is greater than the temperature threshold.

2. The system of claim 1, further comprising:

an electrical system coupled to the engine, the electrical system generating electrical power based on torque generated by the engine, the electrical system being electrically coupled to the catalytic emissions control device; and the controller being configured to adjust the electrical system to provide electrical power to heat the catalytic emissions control device in response to the temperature of the catalytic emissions control device being less than the temperature threshold.

3. The system of claim 2, further comprising:

a plurality of traction motors coupled to the electrical system, the plurality of traction motors being configured to generate tractive power to propel the rail-vehicle system and generate electrical power from braking the rail-vehicle system; and the controller being configured to, during a braking condition when the plurality of traction motors is generating electrical power, adjust the electrical system to provide at least some electrical power generated by the plurality of traction motors to heat the catalytic emissions control device.

4. The system of claim 1, further comprising:

a bypass line coupled between an exhaust passage of the engine and the ventilation hose, the bypass line being coupled to the ventilation hose upstream of the catalytic emissions control device;

a bypass valve positioned to control an amount of exhaust gas that travels from the exhaust passage, through the bypass line; and the controller being configured to adjust a state of the bypass valve to increase the amount of exhaust gas that travels through the bypass line to the catalytic emissions control device when the temperature of the catalytic emissions control device is less than the temperature threshold, and adjust the state of the bypass valve to decrease the amount of exhaust gas that travels through the bypass line to the catalytic emissions control device when the temperature of the catalytic emissions control device is greater than the temperature threshold.

5. The system of claim 4, wherein the controller is further configured to adjust an engine operating parameter to increase an exhaust gas enthalpy when the temperature of the catalytic emissions control device is less than the temperature threshold.

6. An engine system comprising:

an engine including a crankcase;

a ventilation hose coupled to the engine to vent a crankcase gas from the crankcase;

a coalescer coupled to the ventilation hose to condense oil in the crankcase gas;

a catalytic emissions control device coupled to the ventilation hose downstream of the coalescer to treat particulate matter in the crankcase gas;

a bypass line coupled between an exhaust passage of the engine and the ventilation hose, the bypass line being coupled to the ventilation hose upstream of the catalytic emissions control device;

a bypass valve positioned to control an amount of exhaust gas that travels from the exhaust passage, through the bypass line; and a controller configured to adjust a state of the bypass valve to increase the amount of exhaust gas that travels through the bypass line to the catalytic emissions control device when a temperature of the catalytic emissions control device is less than a temperature threshold, and adjust the state of the bypass valve to decrease the amount of exhaust gas that travels through the bypass line to the catalytic emissions control device when the temperature of the catalytic emissions control device is greater than the temperature threshold.

7. The system of claim 6, wherein the controller is further configured to adjust an engine operating parameter to increase an exhaust gas enthalpy when the temperature of the catalytic emissions control device is less than the temperature threshold.

8. A rail vehicle comprising:

a wheel;

a traction motor connected to the wheel;

an electrical system; and the engine system of claim 6, wherein the engine is a diesel engine configured to generate a torque output that is transmitted to the electrical system for generating electricity provided to the traction motor.

9. engine system comprising:

an engine including a crankcase;

a ventilation hose coupled to the engine to vent a crankcase gas from the crankcase;

a coalescer coupled to the ventilation hose to condense oil in the crankcase gas;

a catalytic emissions control device coupled to the ventilation hose downstream of the coalescer to treat particulate matter in the crankcase gas;

an exhaust line coupled to the ventilation hose downstream of the catalytic emissions control device, the exhaust line connecting the ventilation hose to an exhaust stack;

an intake line coupled to the ventilation hose downstream of the catalytic emissions control device, the intake line connecting the ventilation hose to an air-intake passage;

a valve positioned downstream of the catalytic emissions control device, the valve being adjustable to direct the crankcase gas from the catalytic emissions control device to one or more of the exhaust line and the intake line; and a controller configured to adjust a state of the valve to direct the crankcase gas from the catalytic emissions control device to the intake line when a temperature of the catalytic emissions control device is less than a temperature threshold, and adjust the state of the valve to direct the crankcase gas from the catalytic emissions control device to the exhaust line when the temperature of the catalytic emissions control device is greater than the temperature threshold.

10. A rail vehicle comprising:

a wheel;

a traction motor connected to the wheel;

an electrical system; and the engine system of claim 9, wherein the engine is a diesel engine configured to generate a torque output that is transmitted to the electrical system for generating electricity provided to the traction motor.

11. A method comprising:

determining a performance of a catalytic emissions control device in an engine that includes a crankcase, a ventilation hose coupled to the engine to vent a crankcase gas from the crankcase, and the catalytic emissions control device coupled to the ventilation hose to treat particulate matter in the crankcase gas; and varying an amount of the crankcase gas from the catalytic emissions control device to an air-intake passage and an exhaust stack of the engine responsive to the catalytic emissions control device performance that is determined.

12. The method of claim 11, wherein catalytic emissions control device performance includes a catalytic emissions control device temperature and varying includes directing more of the crankcase gas to the air-intake passage when the catalytic emissions control device temperature is lower and directing more of the crankcase gas to the exhaust stack when the catalytic emissions control device temperature is higher.

13. The method of claim 11, wherein catalytic emissions control device performance includes a catalytic emissions control device temperature and varying includes directing the crankcase gas to the air-intake passage when the catalytic emissions control device temperature is less than a temperature threshold and directing the crankcase gas from the catalytic emissions control device to the exhaust stack when the catalytic emissions control device temperature is greater than the temperature threshold.

14. The method of claim 11, wherein the catalytic emissions control device is an electrically-heated catalytic emissions control device coupled to an electrical system, the method further comprises:

varying an amount of electrical power provided by the electrical system to heat the electrically-heated catalytic emissions control device responsive to catalytic emissions control device performance.

15. The method of claim 11, wherein a bypass line is coupled between an exhaust passage of the engine and the ventilation hose, the bypass line being coupled to the ventilation hose upstream of the catalytic emissions control device, the method further comprises:

varying an amount of exhaust gas from the exhaust passage, through the bypass line, to the catalytic emissions control device responsive to catalytic emissions control device performance.

16. The method of claim 11, further comprising:

adjusting an engine operating parameter to vary an exhaust gas enthalpy responsive to catalytic emissions control device performance.

* * * * *